United States Patent [19]

Takano et al.

[11] 3,946,832

[45] Mar. 30, 1976

[54] DIAPHRAGM FOR LOUD SPEAKER

[75] Inventors: Kazuro Takano, Hirakata; Masakuni Hirata, Katano; Yasuo Kodera, Hirakata, all of Japan

[73] Assignee: Matsushita Electric Industrial Co., Ltd., Japan

[22] Filed: Dec. 4, 1974

[21] Appl. No.: 529,505

[30] Foreign Application Priority Data

Dec. 14, 1973 Japan ..... 48-140621

[52] U.S. Cl. ..... 181/167; 181/169; 252/8.1; 428/422

[51] Int. Cl.[2] ..... G10K 13/00; H04R 7/00

[58] Field of Search ..... 181/167, 169; 252/8.1; 428/421, 422

[56] References Cited

UNITED STATES PATENTS

| | | | |
|---|---|---|---|
| 3,717,218 | 2/1973 | Shiga et al. | 181/167 |
| 3,729,434 | 4/1973 | Todd | 252/8.1 |
| 3,740,264 | 6/1973 | Lynch, Jr. et al. | 252/8.1 |
| 3,770,493 | 11/1973 | Gilbert | 428/421 |
| 3,790,403 | 2/1974 | Ribbans | 428/422 |
| 3,811,933 | 5/1974 | Uffner et al. | 428/421 |

*Primary Examiner*—Stephen J. Tomsky
*Attorney, Agent, or Firm*—Burgess, Ryan and Wayne

[57] ABSTRACT

A diaphragm for a loud speaker is manufactured by impregnating a diaphragm blank made of natural or man-made fibers or formed by molding a synthetic resin, with a water-soluble inorganic flame retarder, and thereafter with an aqueous solution of a fluorine containing water repellent and oil repellent agent, and then by heating and molding into a speaker diaphragm.

5 Claims, 1 Drawing Figure

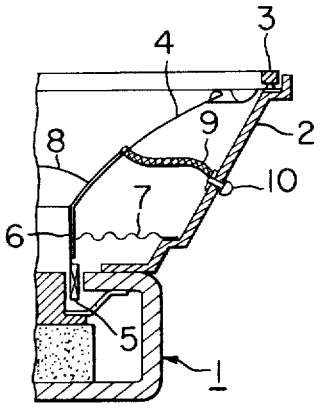
3
4
9
2
8
10
7
6
5
1

DIAPHRAGM FOR LOUD SPEAKER

BACKGROUND OF THE INVENTION

The present invention relates to a diaphragm for a loud speaker.

In order to prevent a fire, flame-retarding treatment of various components not only in electrical equipment but also in acoustic equipment is required. Therefore, flame-retarding of speakers is also required. In conventional flame-retarded speakers, a flame-retarding coating is formed upon the surface of a diaphragm made of natural or synthetic fibers or formed by molding a synthetic resin. Consequently, the mass of such speaker diaphragm is inevitably increased, resulting in a decrease in acoustic pressure and in the degradation of the better physical properties of the original diaphragm. Thus, the acoustic characteristics of the speaker are considerably degraded.

It is well known that salts of phosphoric acid, especially ammonium phosphate, is a preferred inorganic flame retarder for cellulose, but ammonium phosphate has high hygroscopic property, and strongly attacks metals, especially copper. Moreover, it is difficult to apply ammonium phosphate to cellulose, and ammonium phosphate gives rise to the growth of mold.

The organic flame retarders containing halogens and phosphorus are very expensive in general and have a fatal defect in that smoke is produced when the articles treated with such a flame retarder are exposed to fire.

SUMMARY OF THE INVENTION

Briefly stated, according to the present invention, a diaphragm for a loud speaker is manufactured by impregnating a flat blank of a diaphragm which is made of natural or synthetic fibers or formed by molding a synthetic resin, with a water soluble inorganic flame retarder such as diammonium hydrogen phosphate, polyammonium phosphates, or the like and thereafter with an aqueous solution water repellent and oil repellent agent containing fluorine and by molding the blank into the diaphragm. Therefore, the flame-retarding of the speaker diaphragm may be attained; water repellency may be improved; and the growth of mold and the corrosion of metal parts may be positively prevented.

BRIEF DESCRIPTION OF THE DRAWING

Single FIGURE shows a fragmentary sectional view of a speaker using a diaphragm in accordance with the present invention.

DESCRIPTION OF THE PREFERRED EMBODIMENT:

According to the present invention, a diaphragm for a loud speaker is made by impregnating a flat sheet of pulp fiber or the like with a 20% aqueous solution of a watersoluble inorganic flame retarder such as diammonium hydrogen phosphate, polyammonium phosphate, or the like; drying the sheet; impregnating the sheet with a 3% aqueous solution of water repellent and oil repellent agent containing fluorine such as polytetrafluoroethylene; and thereafter heating and molding into a speaker diaphragm at a temperature of from 180°C to 200°C.

With respect to various properties, the speaker diaphragm in accordance with the present invention was compared with the conventional speaker diaphragms, and the results are shown below.

1. Growth of Mold

The speaker diaphragms were placed in a constant temperature chamber kept at 55°C and higher than 95% in humidity.

1. Speaker diaphragm not treated:
   No growth of mold for three months.
2. Speaker coated with a water-soluble inorganic flame retarder:
   Growth of mold was observed after 20 days.
3. Speaker diaphragm in accordance with the present invention:
   No growth of mold for 3 months.

2. Sizing Effect (mean value of testing five sheets at a time)

1. Speaker diaphragm not treated:
   17.8 sec.
2. Speaker diaphragm coated with a water-soluble inorganic flame retarder:
   7.0 sec.
3. Speaker diaphragm in accordance with the present invention:
   27.8 sec.

3. Water Repellency

1. Speaker diaphragm not treated:
   $R_0$
2. Speaker diaphragm coated with a water-soluble inorganic flame retarder:
   $R_0$
3. Speaker diaphragm in accordance with the present invention:
   $R_{10}$ Water repellency is denoted by $R_0$ through $R_{10}$, and the higher the subscript, the better the water repellency becomes.

4. Corrosion

The samples were attached with copper wires and placed in a constant temperature chamber kept at 55°C and higher than 95% in humidity.

1. Speaker diaphragm not treated:
   Turned to light black in color after 30 days.
2. Speaker diaphragm coated with a water-soluble inorganic flame retarder:
   After 30 days, turned to green-blue in color, exhibiting considerable corrosion.
3. Speaker diaphragm in accordance with the present invention:
   After 30 days, turned to light black in color.

Next referring to the single FIGURE, a diaphragm 4, which is impregnated with a flame retarder in the manner described hereinbefore, is attached with a gasket 3 upon the periphery of a frame 2 which in turn is attached to a magnet structure 1. At the center of the diaphragm 4 is suspended a coil bobbin 6 around which is attached a voice coil 5. At the midpoint of the coil bobbin 6, it is supported by a damper 7, and a dust cap 8 is at the central upper surface portion of the diaphragm 4. Both ends of the voice coil 5 are extended along the coil bobbin 6 and the diaphragm 4, and are connected at the midpoint of the diaphragm to lead wires 9 which in turn are connected to terminals 10.

What is claimed is:

1. A diaphragm for a loud speaker made of cellulose impregnated with a solution of a water-soluble inorganic flame retarder and with a solution of a water repellent and oil repellent agent containing fluorine.

2. A diaphragm as defined in claim 1 wherein said water soluble inorganic flame retarder is diammonium hydrogen phosphate; and said water repellent and oil repellent agent containing fluorine is polytetrafluoroethylene.

3. A diaphragm as defined in claim 1 wherein said water soluble inorganic flame retarder is a polyammonium phosphate; and water repellent and oil repellent agent containing fluorine is polytetrafluoroethylene.

4. A diaphragm as defined in claim 1 wherein said solution of said water soluble inorganic flame retarder is a 20% aqueous solution of diammonium hydrogen phosphate; and said solution of said water repellent and oil repellent agent containing fluorine is a 3% aqueous solution of polytetrafluoroethylene.

5. A diaphragm as defined in claim 1 wherein said solution of said water soluble inorganic flame retarder is a 20% aqueous solution of polyammonium phosphate; and said water repellent and oil repellent agent containing fluorine is a 3% aqueous solution of polytetrafluoroethylene.

* * * * *